United States Patent [19]

Evans et al.

[11] Patent Number: 4,957,566

[45] Date of Patent: Sep. 18, 1990

[54] ACID CLEANING OF DRUMS WITH INTERIOR LININGS

[76] Inventors: Ronald J. Evans, 41 Colony Rd; Janice E. Hamilton, 50 Colony Rd., both of Gretna, La. 70053

[21] Appl. No.: 814,976

[22] Filed: Dec. 31, 1985

Related U.S. Application Data

[63] Continuation-in-part of Ser. No. 796,159, Nov. 8, 1985, abandoned.

[51] Int. Cl.[5] ..... B08B 9/00

[52] U.S. Cl. ..... 134/22.14; 134/3; 134/10; 134/22.18; 134/25.1; 134/25.4; 134/26; 134/27; 134/32; 134/33; 134/34; 134/38; 134/41; 134/107; 134/166 R

[58] Field of Search ..... 134/25.1, 25.4, 26, 134/32–34, 10, 3, 27, 38, 41, 107, 22.18, 166, 22.14

[56] References Cited

U.S. PATENT DOCUMENTS

| | | | |
|---|---|---|---|
| 3,033,024 | 5/1962 | Kradoska | 73/49.2 |
| 3,084,076 | 4/1963 | Loucks | 134/22.1 |
| 3,615,822 | 10/1971 | Molinari | 134/24 |
| 3,798,066 | 3/1974 | Evans | 134/3 |
| 4,314,856 | 2/1982 | Steinel | 134/30 |

FOREIGN PATENT DOCUMENTS

| | | | |
|---|---|---|---|
| 2075202 | 11/1981 | United Kingdom | 73/49.2 |

*Primary Examiner*—Curtis R. Davis
*Attorney, Agent, or Firm*—Sherman Levy

[57] ABSTRACT

A method and means is provided for cleaning of drums with interior linings wherein sulfuric acid is utilized. The process of the present invention is especially suitable for cleaning epoxy, phenolic, epoxy phenolic linings and other linings from steel drums. In certain instances chains may be used in conjunction with the cleaning process.

4 Claims, 2 Drawing Sheets

IN
20
23
DRUM PREHEATER, 21
STORAGE TANK, 25
28
26
P
29
HOLDING TANK, 27
30
24
LOADER, 22
REVOLVER, 31
NEUTRALIZATION TANK, 33
34
35
43
UPENDER, 32
HEATING TUNNEL, 17
VACUUM TANK, 39
40
42
OVERFLOW TANK, 36
37
38
41
19
TO FIG.2

ACID CLEANING OF DRUMS WITH INTERIOR LININGS

CROSS REFERENCE TO RELATED APPLICATIONS

The present invention is a continuation-in-part of prior U.S. Patent Application Serial No. 796159.

FIELD OF INVENTION

The present invention relates to the cleaning of drums such as 55 gallon steel drums, and the present invention is especially suitable for cleaning epoxy, phenolic, epoxy phenolic linings and other linings from steel drums. Sodium hydroxide is utilized, and chains may be used at times to improve the desired results.

DISCLOSURE OF THE PRIOR ART

Previously, various types of methods and apparatus for cleaning drums have been provided, as for example as shown in the prior U.S. Pat.: Nos. 3,352,723, H. Smull, 3,798,066, Robert C. Evans. It is submitted that pr patents nor any other known to applicant accomplished the advantages and improvements that are achieved or accomplished by the present invention.

BACKGROUND AND SUMMARY OF THE INVENTION

The present invention is directed to acid cleaning of drums with interior linings. In accordance with the process of the present invention, the drum from which the previous contents have been removed that has been rinsed and dried, but still contains the lining, will be rerouted to the sulfuric acid cleaning process. Assuming the drum is provided in a relatively warm condition, ambient to approximately 130° fahrenheit initially. Next, there is poured into a drum through an appropriate metering device, suitable quantity of sulfuric acid at approximately 99% purity. Next, plugs are screwed into the drums so that the acid will not leak out and the drums are revolved on a device that rolls and tilts the drums. Then the plugs are removed and the excess acids are removed from the drum by an appropriate method. Next, the drum is placed over a nozzle with the bung end down for a reasonable period of time during which time hot caustic soda or some other cleaning solution is pumped into the drum which flows out by gravity.

An object of the present invention is to provide a process of acid cleaning of drums with interior linings that is efficient to use, and which is relatively economical to carry out, and wherein the process is a practical method and means of accomplishing the desired results.

Other objects of the invention will appear in the following description.

DESCRIPTION OF THE PREFERRED EMBODIMENT

Figure 1:
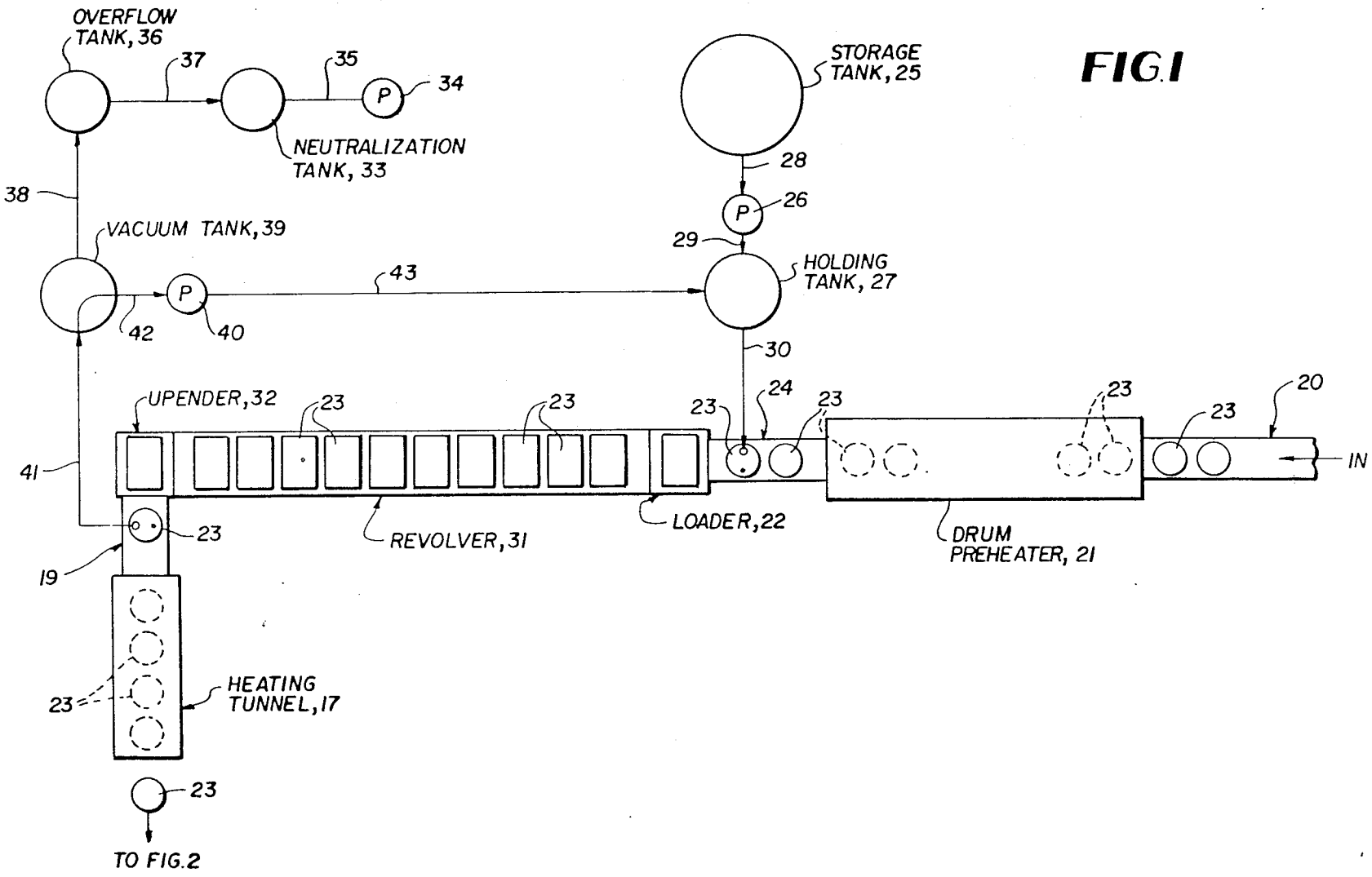
FIG. 1 is a schematic view illustrating a portion of the present invention.

Referring now in detail to the drawings, and more particularly to FIG. 1 of the drawings, the numerical 20 indicates the inlet for the drums to be cleaned, and the numeral 21 indicates a drum preheater. Also in FIG. 1, in area 24, sulfuric acid is introduced into the drums 23.

The numeral 25 indicates a suitable storage tank, and there is further provided a holding tank 27 and a pump 26. A suitable line or conduit 28 can connect the storage tank 25 to the pump 26, and a line or conduit 29 serves to connect the pump 26 to the tank 27. Sulfuric acid is introduced into drums 23 by means of a suitable line, conduit or the line 30.

As a next step, in zone or area 31, the drums 23 are revolved, and in area 32 the drums are tilted. In FIG. 1, the numeral 33 indicates a tank and a neutralization solution such as sodium hydroxide. A pump 34 is suitably connected as at 35 to the neutralization tank 33, and an overflow tank 36 is operatively connected to the tank 33 as at 37. Vacuum tank 39 has lines or conduits 38 and 41 suitably connected thereto A pump 40 has lines or conduits 42 and 43 connected thereto for a purpose to be later described.

Figure 2:
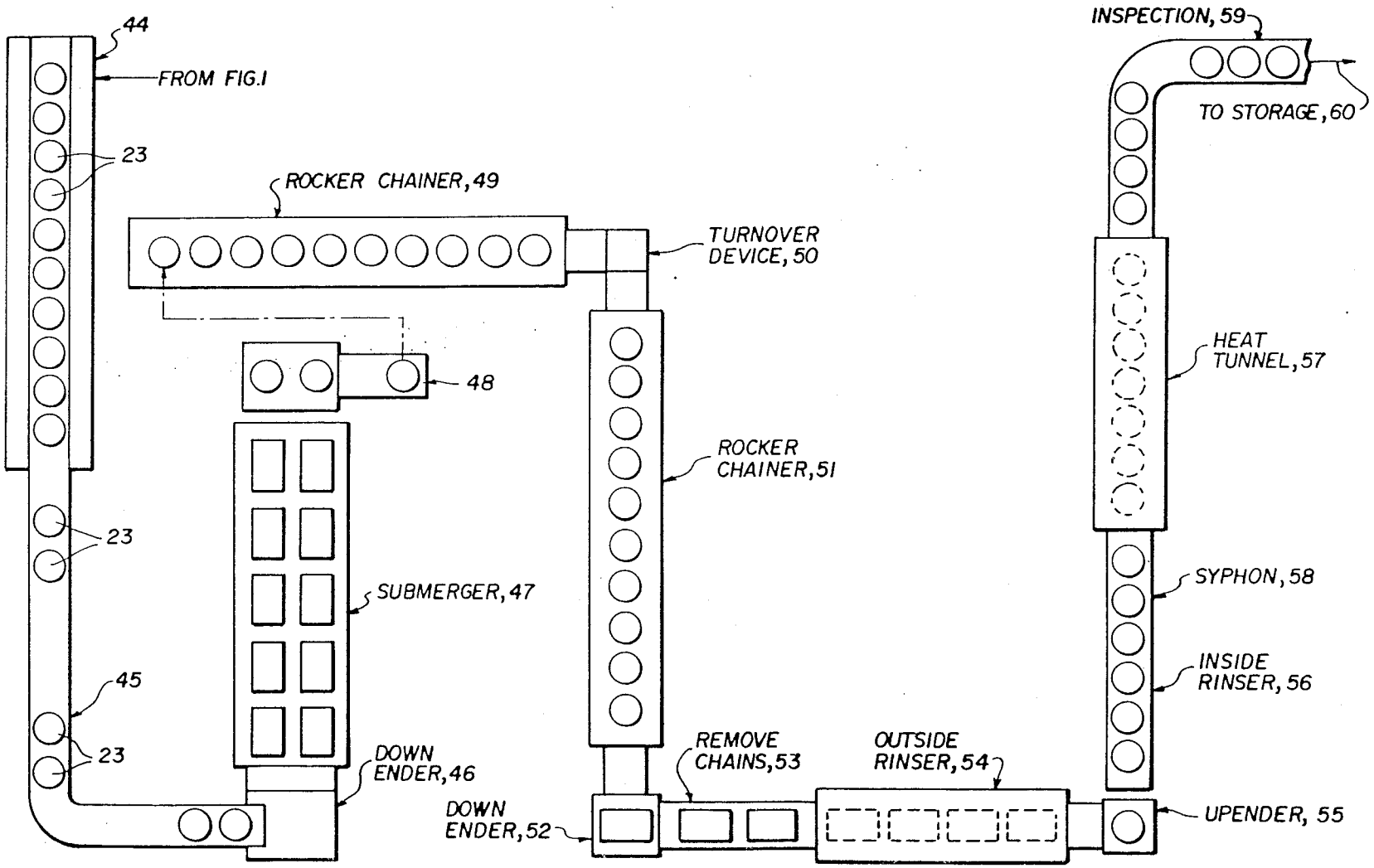
FIG. 2 is a schematic or diagramatic view illustrating certain features of the present invention.

Attention is directed to FIG. 2 of the drawings wherein the numeral 44 indicates a zone or area or location where the hot caustic soda is introduced. As a next step, the drums 23 are moved to a position 45 where chains may be inserted, and at location 46 there is indicated a down ender. The next step in the process occurs in the area 47, which indicates the drum submerger station. At point 48 the drums are moved to a drum rocker chainer 49, and the numeral 50 indicates a 180° turnover device. In the next step in the area 51, there is indicated the rocker chainer. At point 52 there is indicated a down ender, and at station 53 the chains are removed. The numeral 54 indicates a outside rinser, and next the drums are upended as at 55. The drums are then acted upon by an inside rinser 56 and then by a siphon area 58, which is followed by the heating tunnel 57. The numeral 59 indicates an inspection station or area, and finally, the cleaned drums are transported or moved to a suitable storage area along with the path indicated by the numeral 60.

The parts can be made of any suitable material and in different shapes or sized as desired or required.

The acid cleaning of drums with interior linings practiced according to the present invention makes practical and economically feasible the removal of baked interior protective linings from drums and containers between the sizes of 15 gallons and 60 gallons.

It is to be noted that most of the steel 55 gallon drums being used today are the so-called 55 gallon drums that have a height of approximately 34-¾ and a diameter of approximately 23-½inches at the rolling hoop, whereas the largest amount of steel drums are produced without an interior lining, a substantial amount are lined by a method that usually includes spraying into the interior of the drum a lining material which is baked in an oven at temperatures up to 500 degrees fahrenheit.

As is noted, the purpose of the lining is:

(1) To protect the interior of the steel drum from being attached by the product contained in the drum.

(2) To protect the product in the drum from being affected by contact with the steel in the drum.

(3) A combination of both of the above as indicated in 1 and 2.

It is to be noted that linings are not limited to, but generally fall in the following ranges:

(1) A phenolic.

(2) A combination of various mixtures of phenolic and epoxy.

(3) Epoxy.

The removal from a phenolic type drum can usually be achieved within reasonable economic range by present methods, but the removal from a closed type drum of a lining that is epoxy or a combination of epoxy and phenolic is not one that can be done within the bounds of economic feasibility or reality by systems presently in existence or that are known.

In order to correct this, some of the these bung type drums are currently modified by removing the covers and sending the drum with one end into an incinerator which burns the lining. Subsequently, this drum with one end intact is sent through a shot blasting machine to remove the charred material that remains after burning of the contents including the lining. Later the drum is converted into an open head type drum or in some instances rebuilt into a bung type drum by rolling in a new top or bottom.

As a practical matter, there is a limited demand for the first type of drum simply because relatively few removable or open top drums are used. Also, there is a limited demand for the second type drum for reasons such as the following:

1. The length and capacity of the drum is reduced by rolling in a new end.
2. The burning of the drum subjects the end that remains into possible leakage.
3. Further, this is an expensive procedure requiring not only considerable additional work, but a new top or bottom.

In accordance with the new acid process of the present invention, the drums are subjected to a normal standard cleaning, the drum is rinsed, dried completely, and inspected.

It is to be noted that heretofore, if any lining remained in a drum (a great majority of the drums presently produced being epoxy, phenolic, or a combination of epoxy phenolic), operators had to subject the drum to the burning process followed by the open head or rebuilding, or through an extensive rotation of the drum through successive cleanings in an attempt to remove a few of the linings.

The latter method was found to be very detrimental from an economic point of view. Under the new process set forth herein, that drum from which the previous contents had been removed and has been rinsed and dried but still contains the lining, will be rerouted to the sulfuric acid cleaning process of the present invention.

The following steps are indicative of the present invention:

Step #1: Assure that the drum is relatively warm and ambient to approximately 130° fahrenheit.

Step #2: There is poured into a drum, an appropriate metering device being utilized, approximately ½ gallon of sulfuric acid at approximately 98% purity. The amount could be as little as a quart or as much as 20 gallons. The quantity of approximately ½ gallon is reasonably believed to be an efficient amount for proper application of the system.

Step #3: Plugs are screwed into the drums so that the acid will not leak out and the drums are revolved on a device that rolls and tilts the drum so that the interior of the drum is totally exposed to the solution for a period of time that could extend up to as much as fifteen minutes.

Step #4: Plugs are removed and excess acids are removed from the drum by an appropriate method, usually a syphon, so that remaining in the drum is only that acid that clings to the wall of the drum and that part of lining that still clings to the wall. The drum at this point can be placed on a conveyor that would increase the time of exposure to the acid remaining in the drum for a reasonable period of time. Such a conveyor could pass through an oven that would heat the drum to a temperature from ambient to several hundred degrees.

Step #5: In this step, the drum is placed over a nozzle with the bung end down for a reasonable period of time (such as three to ten minutes) during which time hot caustic soda or some other cleaning solution is pumped into the drum which flows out by gravity. Some of the lining and acid adhering to the sides of the drums are removed in this process. If the drum is left long enough on this nozzle, it will be removed.

It is to be noted that best economics require that the drum be moved from the machine described above to another cleaning machine which is more or less standard in the industry. In this instance, chains are placed on the interior of the drum and the drum is placed in a machine where the drum, after being submerged approximately half of its diameter, contacts are made with revolving rollers which revolves the drum while in a cleaning solution (usually hot caustic soda). A progressing device progresses the drums, which in the machine may contain approximately twenty drums. At the end of the progression, the drums are lifted from the solution and drained with a chain still remaining in the same.

Next, the drums then progress to a rocking type device that moves the chains back and forth on the bottom of the drums. Subsequently, the drums are turned over on the top so that the drums are thoroughly scratched by the chains.

An operator removes the chains and sends the drums to the device where the drums are rinsed of the solution therein, syphoned out, dried, and then inspected.

It will be noted that the sulfuric acid will remove the lining but will not remove the rust which may have been deposited in the linings or part of the lining of the drum that has been fractured and rusted. In such instances the drums are sent to a chaining or a hydrochloric acid treatment which is standard in the industry for removing rust. Following that, the drum will be rerinsed, dried, and go into further processing which could include dedenting, testing, repairing of leaks, painting and the like.

Also, the treatment does not require the application of virgin acid at each cycle. As a matter of fact, the acid can be reused for a considerable period of time before becoming contaminated, if indeed, in the process of the present invention that will ever occur. It seems that replacing the sulfuric acid consumed will suffice.

It is desired to emphasize that important requirements for the process to be successful are that the previous contents of the drums be removed prior to acid treating. The introduction of high purity sulfuric acid into a drum having unknown contents could be very dangerous and would easily contaminate the system and would result in overall economic failure.

In summary, the drum must be dry since the introduction of any substantial amount of water or other foreign matter could be dangerous and contaminate the system.

Also, after the introduction of the acid, the interior of the drum must be subjected to a substantial flow of the acid over all of the surfaces of the interior of the drum to effect necessary results.

It is to be noted that a reasonable amount of time, if at ambient temperature, must accompany the flow of acid on the interior of the drum. This could be as little as five minutes, or as much as twenty minutes. The acid in the drums should, for best results and for more economical results, be kept at a temperature of above 90° fahrenheit. Also, the acid should be removed from the drum, except that which adheres to the sides before subjecting the drum to a hot solution of caustic soda (sodium hydroxide). It is believed that, in order to obtain the best results, the introduction of chains in the submerging of the drums into a hot solution of caustic soda or some other solution should be used. After rinsing and drying, the drum should be inspected if rust remains, be subjected to the chaining and/or hydrochloric or some similar acid treatment to achieve a commercially clean drum for the desired purposes.

Further, the entire process can be accelerated by initial heating of the drum before the introduction of the acid, by heating the acid or heating the drum in process, and by heating the drum after the contents of the acid have been removed from the drum. The cleaning or neutralizing solution of sodium hydroxide or some similar product operates best when heated, preferably to 170° or 180° fahrenheit for best results. Also, chains are not absolutely necessary, but contribute greatly to the results to be achieved by the present invention.

It will be noted that various types of accessories and the like can be used wherever desired or required.

With further reference to FIGS. 1 and 2 of the drawings, there is illustrated schematically or diagramatically the steps involving cleaning the lining from drums such as steel drums. Initially the drums 23 to be cleaned enter at point 20 and then pass into a drum preheater 21. The numeral 24 indicates the acid fill station. There is provided the main acid storage tank 25, pump 26 and acid holding tank 27. The numeral 30 indicates a flexible hose.

Next, the drums move to a revolver 31 after being in engagement with an autoloader 22. The revolver 31 is illustrated as a 10 drum, 3 directional revolver and the drums may be on the revolver approximately 10 minutes. However, it is to be noted that the present invention is not limited to any size or shape since these elements can be varied as desired or required. The drums then are engaged by an upender 32, and at point or station 19 there is fllustrated in FIG. 1 the syphoned drum tilted 30° until all liquid acid is removed.

Referring now to FIG. 2 of the drawings, the numeral 44 indicates a preflusher which receives hot caustic soda (sodium hydroxide), and the drums 23 may remain on the preflusher approximately 10 minutes. Again it is to be emphasized that the length of such times can be varied as is appropriate.

Next at station or area 45, chains are put into the drums and the drums pass to a downender 46 and then to a submerger 47 which may be a 20 drum submerger.

Subsequently, the drums pass to a rocker chainer 49 which for illustrative purposes is illustrated to be a 10 drum unit. The numeral 50 indicates a 180° turnover device, and the numeral 51 indicates a rocker chainer which may be a 10 drum unit.

Next, the drums pass through the station 52 which is a downender, and at point 53 the chains are removed. The numeral 54 indicates an outside rinser tunnel which is followed by an upender 55. Subsequently, the drums are acted upon by an inside water rinser 56, and the numeral 58 indicates a syphon. In FIG. 2, the numeral 57 indicates a heat tunnel that blows in dry compressed air. At station or area 59, there is provided means for blown in dry compressed air and inspection. Finally the numeral 60 indicates the area leading to storage for the drums.

It will further be seen that there has been provided an acid treating system to remove linings of steel drums.

With reference to the prior patents, the only prior patents that appear relevant are prior U.S. Pat. No. 3,352,723 to Harold Smull for a method of cleaning used steel drums of organic residues, prior U.S. Pat. No. 3,798,066 dated March 19, 1974 to Robert G. Evans.

One of the important differences between the present invention and the Smull process was that the Smull process attempted to literally clean every type of drum by immersing and rotating the drum in a highly concentrated solution of sulfuric acid at approximately 400° fahrenheit. It developed that some drums would implode inside of the machine and develop other problems.

One of the reasons was that steel drums normally contain many different products and conditions, and the Smull process could not handle the uncontrolled environment of so many different products being initially subjected to the process without some method of precleaning.

The process of the present invention requires that the drums be previously cleaned of their original products and be dried completely prior to being introduced into the acid system. The system is designed to remove linings, not the previous contents.

With further reference to prior U.S. Pat. No. 3,798,066 to Robert G. Evans, the advantage of the present invention over this prior patent issued March 19, 1974 was that required the preheating of the drum to substantial temperatures of over 200° fahrenheit prior to the introduction of acids which were introduced to a drum that was not necessarily dry. It was found that the introduction of water into the acid by any method, including residue left in the drum, rendered the use of the acid relatively ineffective.

Further, the use of hydrochloric acid just after the sulfuric acid was not a necessary part of the process unless the drum contained rust as well as the previous linings. Should that occur in the new process, the drum is subsequently subjected to hydrochloric acid for the removal of the rust only. Inasmuch as the use of hydrochloric acid for the removal of rust has been a long standing practice, no claim is being made for that specific feature. As a matter of policy, after the lining has been removed from the drum as part of the process of the present invention, if any rust is in the drums, which represents only a small percentage, they are then subjected to the standard hydrochloric process for the removal of rust only.

As shown in FIG. 1, there is illustrated an additional heating tunnel 17 to which the drums would move in after they have been sphoned. This tunnel 17 would act as a time delay, giving more time exposure to the drum, which, although it has been syphoned, is wetted on the interior with the sulfuric acid. The tunnel 17 would also heat the acid to increase its activity.

Although the present invention has been described and illustrated in detail, it is clearly understood that the same is by way of illustration and example only and is not to be taken by way of limitation, the spirit and scope of the present invention being limited only by the terms of the appended claims.

What is claimed:

1. A method of economically cleaning steel drums that have an interior baked-in lining and wherein the drums have been initially previously cleaned of previous contents and dried completely, the method being useful for completely removing epoxy, phenolic, any combination of epoxy phenolic blend of linings and other linings from drums such as 55 gallon closed type drums comprising substantially the steps of initially supplying the drums from a source of supply, then preheating the drums to a temperature of about 130°F., next introducing a metered quantity of sulfuric acid of about 98% purity into the drums from a source of supply of acid, providing a pumping area, a holding area, and a storage area for the sulfuric acid, then screwing plugs into the drums so that the acid will not leak out, next revolving the drums and tilting the drums so that the interior of the drums are totally exposed to the acid, then removing the plugs and the excess acid from the drums so that remaining in the drums is only that acid that clings to the walls of the drums and that part of the lining that still clings to the walls of the drums, conveying the drums a distance to increase the time of exposure to the acid and passing the drums through a heating area to heat the drums from ambient to several hundred degrees Fahrenheit, next introducing a cleaning solution such as hot caustic soda into the drums to neutralize any acid therein, then placing chains in the interior of the drums and then moving the drums to a rocking area to move the chains back and forth on the bottom of the drums, turning the drums so that the drums are scratched by the chains, then removing the chains, next rinsing the drums of the solution therein, then syphoning out the material in the drums and drying and inspecting the drums, and finally moving the drums to a storage area.

2. The method as defined in claim 1 and wherein if any rust is in the drums or lining, the drums can be subjected to a hydrochloric acid process for the removal of only rust from the drums or linings.

3. An apparatus for economically cleaning steel drums that have an interior baked-in lining, and wherein the drums have been initially previously cleaned of previous contents and dried completely, the apparatus being useful for completely removing epoxy, phenolic, any combination of epoxy phenolic blend of linings and other linings from drums such as 55 gallon closed type drums, consisting of means for initially supplying the drums from a source of supply of drums, a preheater for preheating the drums to a temperature of about 130 °F., means for introducing a metered quantity of sulfuric acid of about 98% purity into the drums from a source of supply, removable plugs for the drums for preventing the acid from leaking out, means for revolving the drums, means for tilting the drums so that the drums have the interior thereof totally exposed to the acid, heating tunnel means for the drums, means for removing the plugs so that excess acid is removed from the drums so that remaining in the drums is only that acid that clings to the walls of the drums and that part of the lining that still clings to the walls of the drums, conveyors for moving the drums a distance to increase the time of exposure to the acid and passing the drums through a heating zone to heat the drums from ambient to several hundred degrees Fahrenheit, means including a pre-flusher for introducing cleaning solution such as hot caustic soda into the drums to neutralize any acids therein, means for placing chains in the interior of the drums, a rocking type device for causing the chains to move back and forth on the bottom of the drums, means for turning the drums so that the drums are scratched by the chains, a submerger for the drums, means for rinsing the drums of the solution therein, means for syphoning out material in the drums, a heat tunnel providing drying means for the drums for blown dry compressed air, means for inspecting the drums, and means for moving the drums to a storage zone.

4. The apparatus as defined in claim 3 wherein there is provided a main storage tank for the acid, an acid holding tank, a pump, conduits connecting the pump to the acid storage tank and acid holding tank, conduits connecting the holding tank to the drums; a neutralization tank, an overflow tank, and a vacuum tank, a pump operatively connected to said neutralization tank, conduits connecting said overflow tank to said vacuum tank, and conduits connecting the vacuum tank to the acid holding tank, and to the areas where liquid acid is removed from the drums.

* * * * *